US007173575B2

(12) United States Patent
Brooker

(10) Patent No.: US 7,173,575 B2
(45) Date of Patent: Feb. 6, 2007

(54) REFLECTOR ANTENNA SUPPORT STRUCTURE

(75) Inventor: Ralph Brooker, Alexandria, VA (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/905,916

(22) Filed: Jan. 26, 2005

(65) Prior Publication Data

US 2006/0164319 A1 Jul. 27, 2006

(51) Int. Cl.
*H01Q 3/02* (2006.01)

(52) U.S. Cl. ..... 343/882; 343/878; 343/892

(58) Field of Classification Search ..... 343/878, 343/890, 892, 882, 840; 248/282.1–287, 248/346.01

See application file for complete search history.

(56) References Cited

U.S. PATENT DOCUMENTS

| | | | | |
|---|---|---|---|---|
| 4,251,819 | A | 2/1981 | Vickland | 343/882 |
| 4,404,565 | A | 9/1983 | Gurney et al. | 343/882 |
| 4,550,319 | A | 10/1985 | Ganssle et al. | 343/882 |
| 4,644,365 | A | 2/1987 | Horning et al. | 343/882 |
| 4,652,890 | A | 3/1987 | Crean | 343/882 |
| 4,750,002 | A | 6/1988 | Kommineni | 343/915 |
| 4,819,006 | A | 4/1989 | Whitesides et al. | 343/880 |
| 4,819,007 | A | 4/1989 | Tezcan | 343/880 |
| 4,845,510 | A | 7/1989 | Chang et al. | 343/880 |
| 4,924,239 | A | 5/1990 | Ceklovsky | 343/882 |
| 4,980,697 | A | 12/1990 | Eklund | 343/882 |
| 5,000,408 | A | 3/1991 | Bourgeois et al. | 343/882 |
| 5,392,057 | A * | 2/1995 | Lin | 343/882 |
| 5,402,140 | A | 3/1995 | Rodeffer | 343/882 |
| 5,440,320 | A | 8/1995 | Lach et al. | 343/915 |
| 5,512,913 | A | 4/1996 | Staney | 343/781 P |
| 5,657,031 | A | 8/1997 | Anderson et al. | 343/757 |
| 5,933,123 | A | 8/1999 | Kaul | 343/879 |
| 5,999,139 | A | 12/1999 | Benjamin et al. | 343/765 |
| 6,208,317 | B1 | 3/2001 | Taylor et al. | 343/915 |
| 6,225,962 | B1 | 5/2001 | Blanchard et al. | 343/880 |
| 6,323,822 | B2 | 11/2001 | Cook et al. | 343/840 |
| 6,361,007 | B1 * | 3/2002 | Oby et al. | 248/285.1 |
| 6,462,718 | B1 | 10/2002 | Ehrenberg et al. | 343/880 |
| 6,657,598 | B2 | 12/2003 | Tulloch | 343/765 |
| 6,864,855 | B1 * | 3/2005 | Fujita | 343/882 |
| 6,963,316 | B1 * | 11/2005 | Lin | 343/882 |
| 2004/0169114 | A1 | 9/2004 | Dierkes | 248/165 |

* cited by examiner

*Primary Examiner*—Hoang V. Nguyen
*Assistant Examiner*—Ephrem Alemu
(74) *Attorney, Agent, or Firm*—Babcock IP, PLLC

(57) ABSTRACT

A support structure apparatus for a reflector antenna having a main reflector. The support structure includes a plurality of sub-brackets and a main bracket. The sub-brackets each having a plurality of main reflector connection points and a main bracket connection point. A plurality of fasteners used to join the main reflector to the sub-brackets and the sub-brackets to the main reflector swivel when loose and become rigid when fastened. Fasteners between the sub-bracket and the main bracket may be replaced with captive screws or motors with threaded shafts to provide azimuth/elevation adjustment functionality to the support structure.

26 Claims, 3 Drawing Sheets

REFLECTOR ANTENNA SUPPORT STRUCTURE

BACKGROUND

The main reflector of a reflector antenna is typically mounted via a support structure. To avoid performance degradation, it is important that the shape of the main reflector of a reflector antenna is maintained. For cost reduction purposes, the main reflector may be molded or stamped from materials such as plastic or metal having relatively low stiffness characteristics. To add support for these reflectors, and thereby maintain their shape, a support structure having multiple contact points distributed across the main reflector may be applied.

Prior rigid support structures having multiple contact points distributed across the main reflector necessarily have imperfect shape accuracy due to manufacturing tolerances. In the case of exactly three mounting points, the reflector is normally not deformed by structure inaccuracies. However three attachment points may not be sufficient for the structure to stiffen the reflector across its surface under load conditions such as wind forces. If the number of contacts exceeds three, the reflector, the support structure, or both necessarily deform when the structure is attached to the reflector, unless additional steps are taken to fit the mis-toleranced attachment points to the reflector, such as shimming, or unless sufficiently tight fabrication tolerances are imposed upon the backstructure. In either case cost is increased.

In more advanced embodiments, support structures may include manual or motor control azimuth/elevation adjustment functionality. However, this functionality may require duplicative and or comparatively complex structures with corresponding increases in the total number of discrete parts required.

The increasing market for reflector antennas used with, for example, consumer satellite TV and or internet satellite communications systems has focused attention on cost reductions resulting from increased materials, manufacturing and distribution efficiencies. Further, reductions in assembly requirements and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
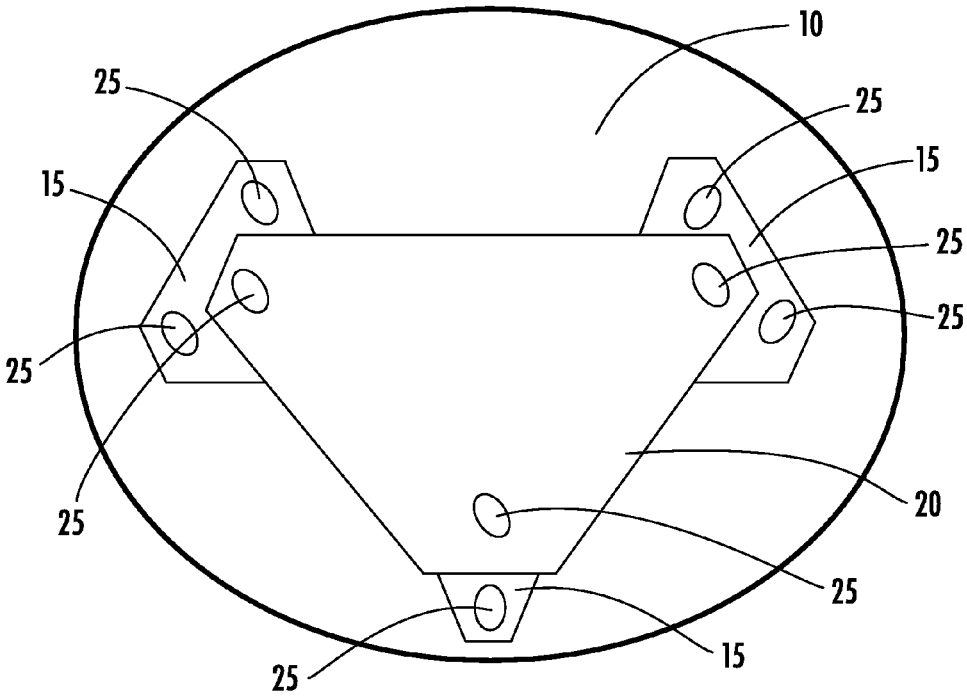
FIG. 1 is a schematic back view of a main reflector with support structure according to a first embodiment of the invention.
Figure 2:
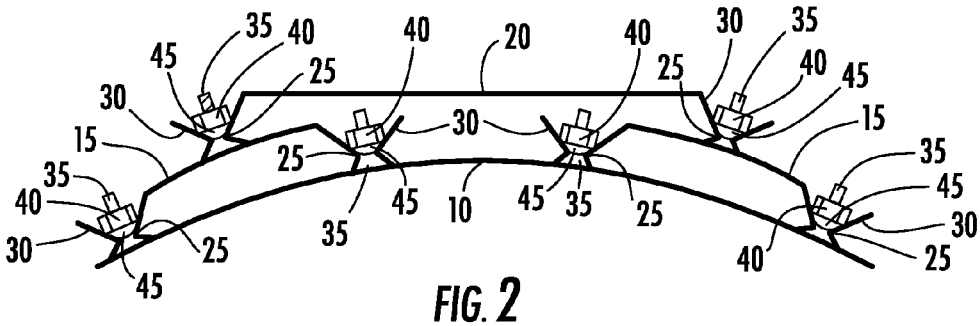
FIG. 2 is a close-up side schematic view of FIG. 1, one of the three hole/screw connections between the main reflector and sub-bracket omitted for clarity.

As shown for example in FIGS. 1 and 2, a first embodiment of the invention provides a distributed nine point connection to a main reflector 10 via three sub-bracket(s) 15 that are each coupled to a main bracket 20. Three connection points between each sub-bracket 15 and the main reflector 10 allow each sub-bracket 15 to be self-leveling. Thereby, the sub-bracket(s) 15 will not deform the main reflector 10 when secured.

Fasteners which swivel when loose but become rigid when connected allow the connection points to mate together without requiring narrowly pre-defined alignment. For the purposes of this specification, "swivel when loose" indicates that the fastener may be freely movable over a range of different angles, prior to connection, and allowing rigid connection at any position or orientation within the range of different angles, as required by the alignment of the elements being coupled. In a first embodiment, each of the connection points between the main reflector 10 and the sub bracket(s) 15 and between the sub-bracket(s) 15 and the main bracket 20 is formed as an oversized, with respect to a diameter of the selected fastener, hole 25 or slot surrounded by a domed area 30. Fasteners such as screw(s) 35 or bolt(s) and nut(s) 40 each have a corresponding domed section 45 that mate with the domed area(s) 30. Thereby, each fastener has a range of angular movement within each oversized hole 25 but is securely fastenable against each respective domed area 30 to form a rigid assembly when the fasteners are fully tightened.

Because of the adjustable nature provided by the range of movement of each fastener, the sub-bracket(s) 15 may be standardized into a single component, even if they are each attached at different areas of the main reflector 10. Similarly, the main bracket 20 is self leveling when mounted upon the sub-bracket(s) 15. Because the fasteners are attachable over a wide range of angles, the same sub-bracket(s) 15 and main bracket 20 are usable upon a wide range of different main reflector 10 embodiments.

One skilled in the art will appreciate that the sub-bracket (s) 15 and main bracket 20 may be cost effectively manufactured without requiring a high degree of manufacturing tolerance due to their adjustable nature. Each sub-bracket 15 and or main bracket 20 may be formed from, for example, stamped metal.

As part of the stamping process, additional reinforcement such as stiffening groove(s) 50 and or turned edge(s) 55 may be incorporated into the components. Further, turned edge(s) 55 of the main bracket 20 may be formed as mounting point(s) 60 for a feed and or sub reflector boom arm 65 as shown for example in FIGS. 3 and 4.

Figure 3:
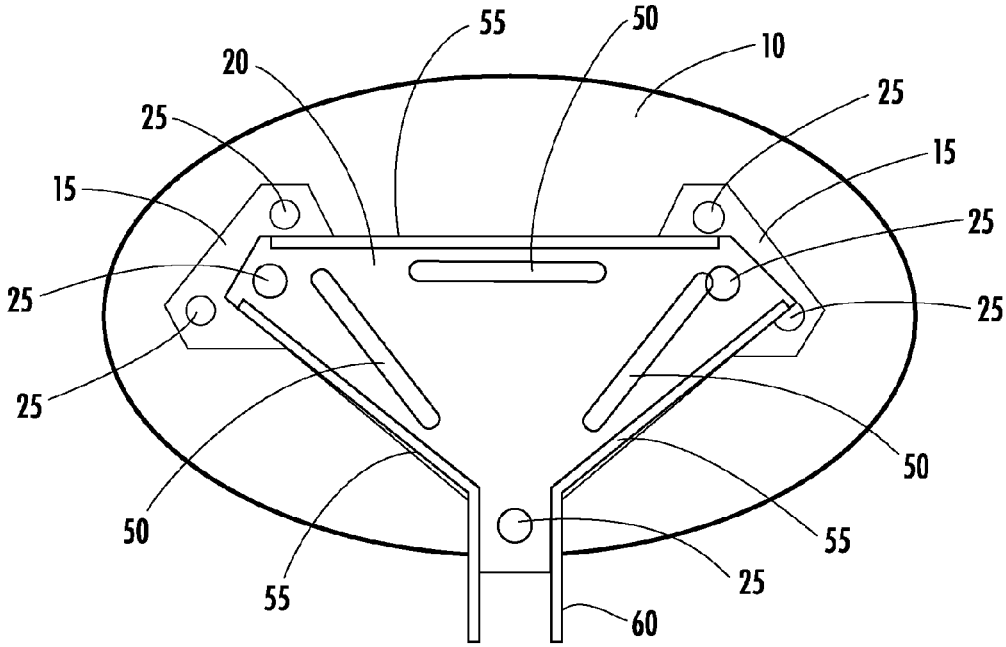
FIG. 3 is a schematic back view of a main reflector with support structure according to a second embodiment of the invention.
Figure 4:
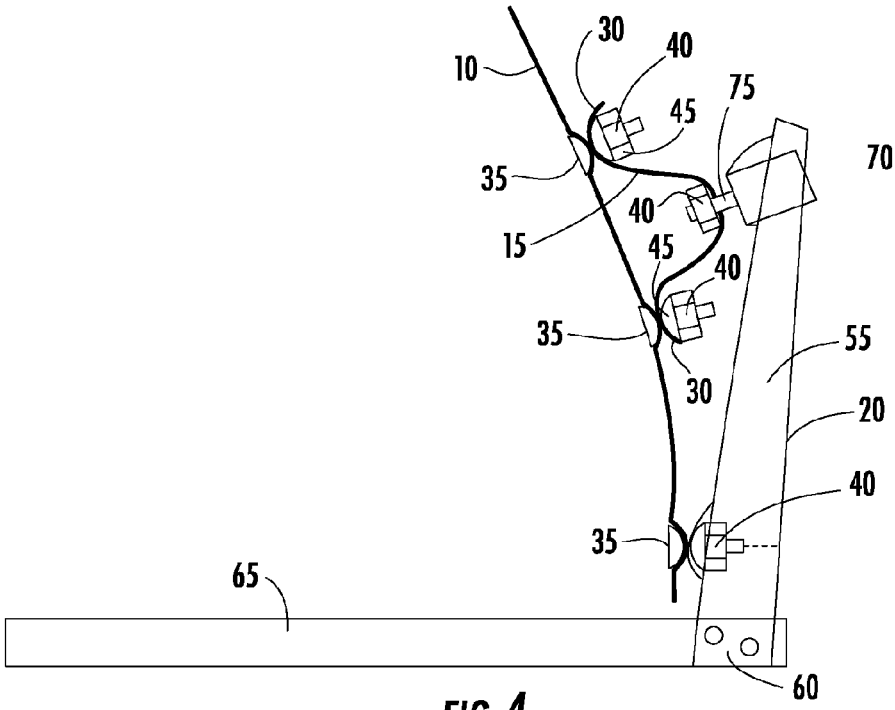
FIG. 4 is a close-up side schematic view of FIG. 3, one of the three hole/screw connections between the main reflector and sub-bracket omitted for clarity.

Depending upon the main reflector 10 characteristics, it is possible to omit one of the sub-bracket(s) 15 and make a single point connection directly between the main reflector 10 and the main bracket 20. Where a direct connection between the main reflector 10 and main bracket 20 is applied, depending upon the size and shape of the main reflector 10, the sub-bracket(s) 15 may be formed with an increased depth, for example as shown in FIGS. 3 and 4. A direct connection between the main reflector 10 and the main bracket 20 may be made near the proximal end of the boom arm 60, in order to minimize any mis-focusing effect on antenna gain and pattern performance due tolerance errors in the main reflector 10, main bracket 20, and or attachment parts.

In an alternative embodiment, preferably wherein the main reflector 10 is formed with appropriate stiffness, main reflector 10 azimuth/elevation adjustment functionality may be incorporated at the interconnection between the sub-bracket(s) 15 and main bracket 20.

Figure 5:
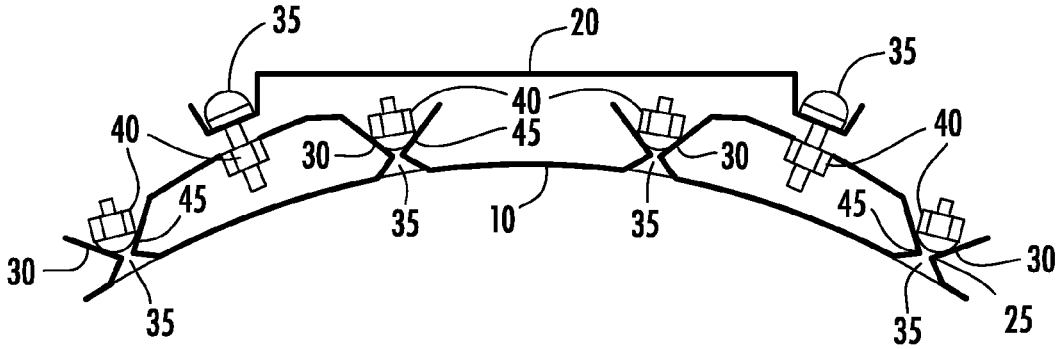
FIG. 5 is close-up side schematic view of a manually adjustable support structure, one of the three hole/screw connections between the main reflector and sub-bracket omitted for clarity.
Figure 6:
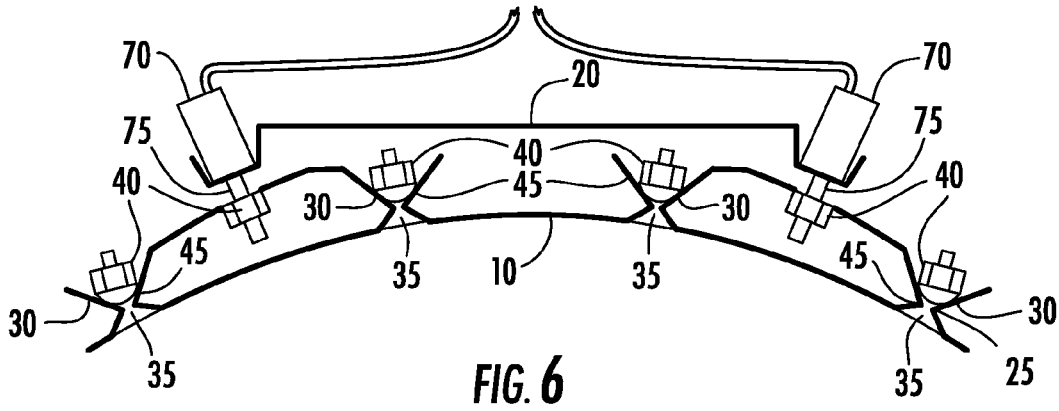
FIG. 6 is a close-up side schematic view of a motor controlled adjustable support structure, one of the three hole/screw connections between the main reflector and sub-bracket omitted for clarity.

As shown for example in FIG. 5, nut(s) 40 coupled to the sub-bracket and screw(s) 35 held captive by the main bracket 20 may be adjusted relative each other to modify the main reflector 20 azimuth/elevation relative the main bracket 20. Similarly, as shown for example in FIG. 6, the screw(s) 35 may be replaced with motor(s) 70 having a threaded shaft 75. Applied in a two sub-bracket configuration similar to that shown in FIG. 3, turning both motor(s) 70 or screw(s) 35 simultaneously in a common direction adjusts elevation while turning them in opposite directions to each other adjusts azimuth.

By incorporating the azimuth/elevation adjustability into the support structure, the requirement for a separately adjustable azimuth/elevation mounting head is eliminated. That is, the reflector antenna may be mounted by direct connection between the main bracket 20 and a desired fixed mounting point.

The present invention provides a simplified distributed multiple mounting point support structure that may be cost effectively manufactured without precision manufacturing tolerances. In the case of a reflector skin which is fabricated accurate to shape but does not have sufficient rigidity to withstand additional loads such as wind forces without a backstructure with more than three attachment points, the invention provides multiple independent sub-structures each with a reduced number of mounting points, significantly improving the overall strength and rigidity of the resulting antenna. Because the substructures are independently attached to the reflector skin and then coupled to a main bracket, the various components may be easily assembled into a rigid assembly with minimal risk of distorting the main reflector shape.

Where the reflector skin is sufficiently rigid, the substructure to main structure interconnections also provide junction points for incorporation of elevation/azimuth control(s) eliminating the costs and potential problems of separate azimuth/elevation adjustment structures.

Significant packaging, inventory and distribution economies are realized because the bare main reflector(s) 10 may be stacked one upon the other, allowing, for example, installation crew vehicles to carry a significantly larger supply of the reflector antennas.

| Table of Parts | |
|---|---|
| 10 | main reflector |
| 15 | sub-bracket |
| 20 | main bracket |
| 25 | hole |
| 30 | domed area |
| 35 | screw |
| 40 | nut |
| 45 | domed section |
| 50 | stiffening groove |

-continued

| Table of Parts | |
|---|---|
| 55 | turned edge |
| 60 | mounting point |
| 65 | boom arm |
| 70 | motor |
| 75 | threaded shaft |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A support structure for a reflector antenna having a main reflector, the support structure comprising:

a main bracket;

a plurality of sub-brackets each having a plurality of main reflector connection points and a main bracket connection point;

a plurality of fasteners movable in a range of angles, prior to rigid connection, and rigidly connectable at any orientation within the range of angles coupleing the main bracket connection points with the main bracket; and the main reflector to the main reflector connection points.

2. The apparatus of claim 1, wherein the sub-brackets have three main reflector connection points.

3. The apparatus of claim 1, wherein the main bracket has three sub-bracket connection points.

4. The apparatus of claim 1, wherein at least one of the fasteners has a domed section adapted to mate with a domed area of at least one of the reflector, the main bracket connection points, the main reflector connection points or the main bracket.

5. The apparatus of claim 4, wherein the fasteners are a screw and a nut.

6. The apparatus of claim 1, wherein the main bracket has stiffening grooves.

7. The apparatus of claim 1, wherein the main bracket has turned edges.

8. The apparatus of claim 1, wherein there are two sub-brackets and a fastener connects between the main reflector and the main bracket.

9. The apparatus of claim 1, wherein the main bracket is adapted to couple with a boom arm.

10. The apparatus of claim 9, wherein the boom arm is coupled via turned edges of the main bracket.

11. The apparatus of claim 9, wherein the coupling of the boom arm to the main bracket is proximal to the fastener connecting the main reflector and the main bracket.

12. The apparatus of claim 1, wherein the sub-brackets and main bracket are stamped metal.

13. The apparatus of claim 1, wherein at least two of the fasteners between the main bracket connection point and the main bracket are screws captive in the main bracket that thread into nuts on the sub-brackets.

14. The apparatus of claim 1, wherein at least two of the fasteners between the sub-bracket connection points and the main bracket connection points are motors with threaded shafts, the motors mounted on the main bracket adapted to thread the threaded shafts into nuts on the sub-brackets.

15. A support structure for a reflector antenna having a main reflector, comprising:

a pair of sub-brackets each having a plurality of main reflector connection points and a main bracket connection point;

a main bracket adapted to couple with a boom arm;

a plurality of fasteners having a domed section adapted to mate with a domed area of each of the main reflector connection points and the main bracket connection points;

the fasteners coupling the main reflector to each of the sub-brackets, each of the sub-brackets to the main bracket and between the main reflector and the main bracket.

16. The apparatus of claim 15, wherein the sub-brackets are integrally formed with the reflector.

17. The apparatus of claim 15, wherein the fasteners are a screw and a nut.

18. The apparatus of claim 15, wherein the boom arm is coupled via turned edges of the main bracket.

19. The apparatus of claim 15, wherein the fasteners between the main bracket connection point and the main bracket are screws captive in the main bracket that thread into the sub-brackets.

20. The apparatus of claim 19, wherein the screws thread into nuts mounted on the sub-brackets.

21. The apparatus of claim 15, wherein the fasteners between the main bracket connection point and the main bracket are motors with threaded shafts mounted on the main bracket that thread into the sub-brackets.

22. The apparatus of claim 21, wherein the threaded shafts thread into nuts mounted on the sub-brackets.

23. A method of manufacturing a support structure apparatus for a reflector antenna having a main reflector, comprising the steps of:

stamping a plurality of sub-brackets and a main bracket out of metal;

the sub-brackets each stamped with a plurality of main reflector connection points and a main bracket connection point;

forming a plurality of fasteners having a domed section adapted to mate with a domed area of each of the main reflector connection points and the main bracket connection points;

coupling each sub-bracket to the main bracket via one of the fasteners at each bracket connection point, the domed section of the fasteners at each main bracket connection point, the domed section of each fastener mating with the domed area of each main bracket connection point.

24. The method of claim 23, wherein the main bracket is stamped with a stiffening groove and a turned edge.

25. In an antenna having a reflector, a boom arm and main bracket, a method for adjusting the beam direction of an antenna, said method comprising the steps of:

attaching the reflector to the main bracket at a point proximate a proximal end of the boom arm;

attaching the reflector to the main bracket at two points with a means for varying a distance between the reflector and the main bracket;

adjusting the means for varying to displace the reflector in independent directions with respect to a distal end of the boom arm, thereby causing the direction of the antenna beam to change.

26. The method of claim 25, where the attachment of the reflector to the main bracket comprises a sub-bracket and fasteners which swivel when loose and are rigid when tightened.

* * * * *